United States Patent [19]

Radus

[11] Patent Number: 4,554,524

[45] Date of Patent: Nov. 19, 1985

[54] SECONDARY CIRCUIT BREAKER FOR DISTRIBUTION TRANSFORMER WITH INDICATOR LIGHT SWITCH MECHANISM

[75] Inventor: Raymond J. Radus, Monroeville Boro, Pa.

[73] Assignee: Westinghouse Electric Corp., Pittsburgh, Pa.

[21] Appl. No.: 643,511

[22] Filed: Aug. 23, 1984

[51] Int. Cl.[4] ..... H01H 37/52

[52] U.S. Cl. ..... 337/3; 335/6; 335/17; 361/38

[58] Field of Search ..... 337/3, 72; 335/6, 15, 335/17, 35; 361/36, 37, 38

[56] References Cited

U.S. PATENT DOCUMENTS

| | | | |
|---|---|---|---|
| 3,983,454 | 9/1976 | Cotton et al. | 335/6 |
| 3,997,857 | 12/1976 | Wien et al. | 335/35 |
| 4,030,053 | 6/1977 | Cotton et al. | 335/15 |
| 4,105,986 | 8/1978 | Gogniat et al. | 337/3 |
| 4,119,935 | 10/1978 | Wien et al. | 335/170 |
| 4,324,961 | 4/1982 | Ristuccia et al. | 335/6 |

*Primary Examiner*—Harold Broome

*Attorney, Agent, or Firm*—L. P. Johns

[57] ABSTRACT

A secondary circuit breaker for a distribution transformer characterized by electrical inductive apparatus within an oil-filled housing, and circuit interrupter for controlling current flow through said apparatus and comprising a releasable latch arm, trip means operable upon overload conditions to release the latch arm, a latch lever between the trip means and the latch arm, and a signal light circuit for activating a signal light when current through the circuit breaker exceeds a low signal overload value. That is less than the trip value.

9 Claims, 13 Drawing Figures

SECONDARY CIRCUIT BREAKER FOR DISTRIBUTION TRANSFORMER WITH INDICATOR LIGHT SWITCH MECHANISM

BACKGROUND OF THE INVENTION

1. Field of the Invention

This invention relates to circuit breakers of the type having a bimetallic thermal trip element and, more particularly, to circuit breakers for distribution transformers with indicator light switch mechanism for indicating a current overload condition exceeding a predetermined current value.

2. Description of the Prior Art

Power transformer systems include transformers in association with other protective devices for preventing or limiting power overload damage to the transformer. A completely self-protected transformer includes a current breaker on the secondary or low voltage side to avoid damage due to overload currents. The secondary current breaker disconnects the transformer from its load if the load current exceeds a predetermined rate. Such transformers are disclosed in U.S. Pat. Nos. 3,983,454; 3,997,857; 4,030,053; 4,105,986; 4,119,935; and 4,324,961.

For overload current conditions, it is desirable that the circuit interruption be completed as rapidly as possible after initiation. For the purpose, circuit breakers commonly incorporate a bimetal thermal trip and an instantaneous magnetic trip.

In the overall design of a breaker mechanism, there are various levers and springs which interact with each other to produce the required functions. Inherent in such mechanism designs, there are trade-offs among the interactions. One such trade-off involves three primed forces which act on a trip bar. One of these forces is from the bimetal. When heated, the bimetal pushes the trip bar toward the main contacts in the mechanism. A second force produced by one of the springs is in opposition to the bimetal force and is directed to rotate the trip bar away from the main contacts. The third force is a friction force which resists rotation in either direction. The friction force is between the interface surfaces of a latch cam and a latch plate and the force exists only when the circuit breaker is closed and latched.

In normal operation, the spring force must be great enough to rotate the trip bar away from the main contacts when the breaker is being reset. The bimetal force must be great enough to overcome the sum of the spring force and the frictional force. The frictional force does not have a prime function in normal operation. However, it does enhance stability giving some immunity to vibration and shock. In relative terms, the spring force is less than the friction force and the bimetal force is greater than their sum. Accordingly, there has been a need for a practical combination of these three forces in circuit breaker mechanisms of the type involved.

SUMMARY OF THE INVENTION

A distribution transformer comprising a housing, an electrical inductive apparatus within the housing, a circuit interrupter disposed within the housing and operable between a closed position permitting current flow through the transformer and an open position interrupting flow through the transformer, the circuit interrupter being operable to automatically trip the open position upon overload current conditions through the transformer, the circuit breaker including a releasable latch arm operable to maintain the circuit breaker in closed position, a latch plate movable between latched and unlatched positions of said arm, a reciprocable cam movable between unlatched and latched positions of the plate and having a cam surface engageable with the plate, reciprocable trip means operable upon overload current conditions to rotate the cam to the unlatched position, signal means for indicating when overload current conditions exceed a predetermined level and including a switch arm and a moving contact on the arm, and the arm being movable with the cam for moving the contact to open and close a signal circuit.

The advantage of the device is that it provides a novel combination of the intrinsic latch function in a circuit breaker mechanism with a simple electrical switch to perform the signal light turn-on function and includes therewith a permanent magnet to enhance electrical contact by compensating for a finite but small relaxation of the circuit breaker mechanism.

DESCRIPTION OF THE PREFERRED EMBODIMENTS

Figure 1:
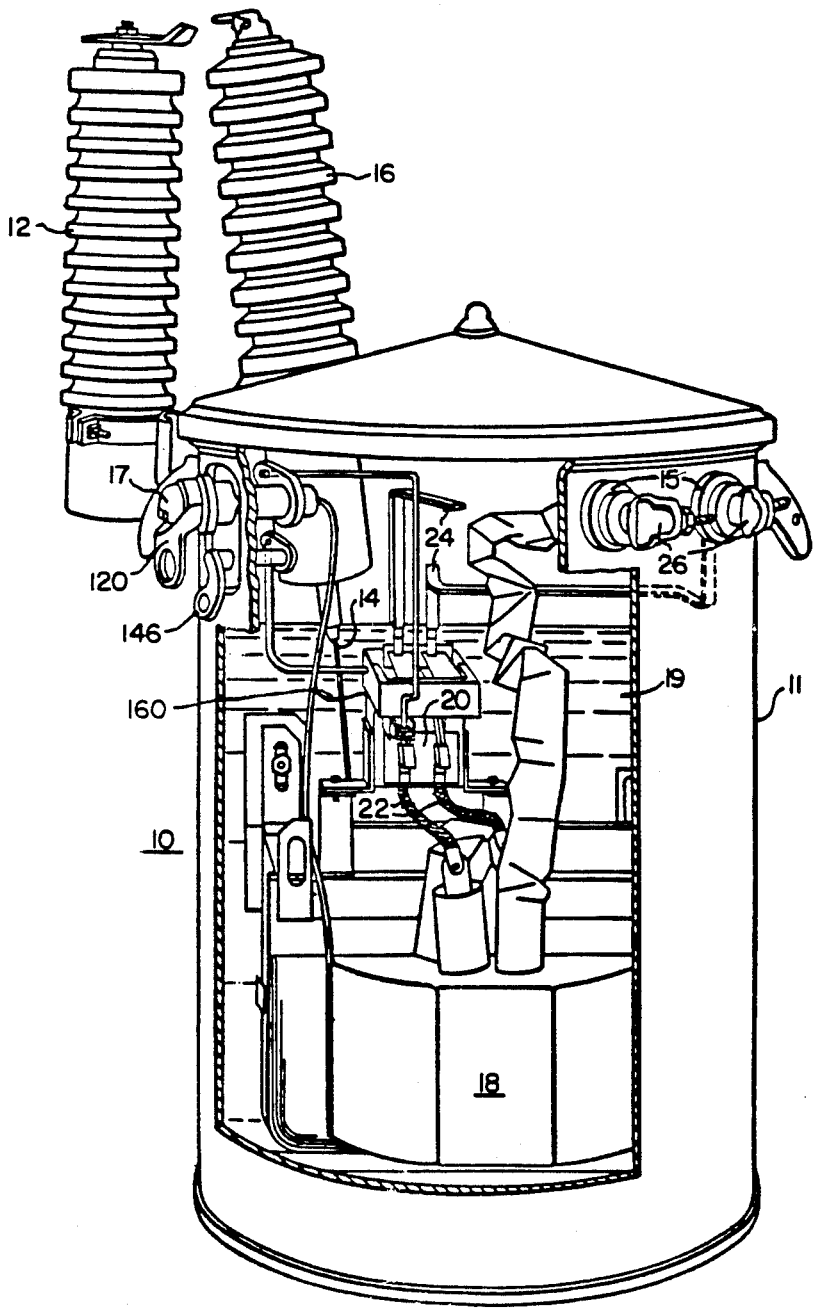
FIG. 1 is a perspective view of an oil-filled distribution transformer utilizing the teaching of the present invention.
Figure 2:
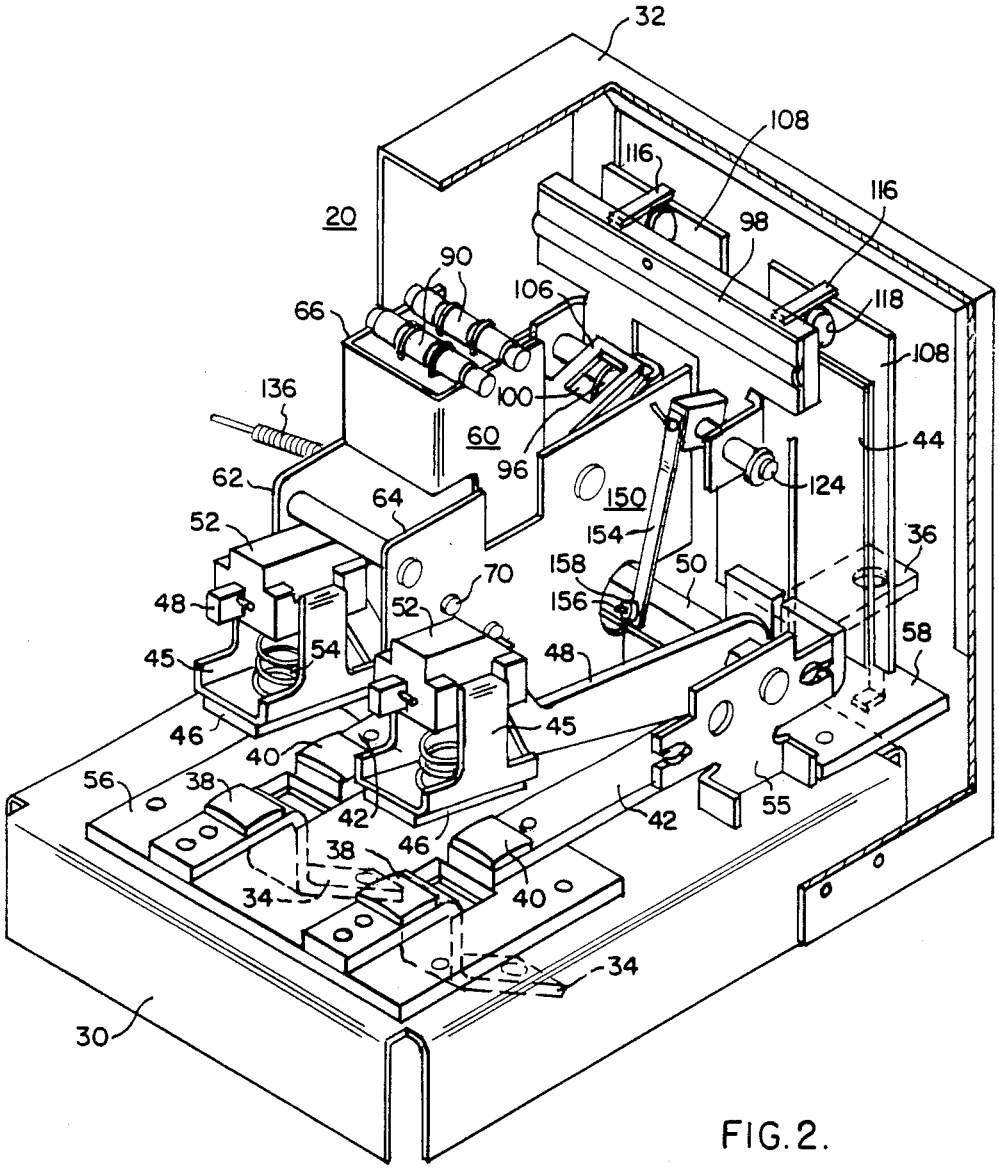
FIG. 2 is a perspective view of a secondary circuit interrupter for use on a distribution transformer utilizing the teaching of the present invention.

In FIG. 1, a pole-type completely self-protected distribution transformer is generally indicated at 10. It includes a circuit breaker 20 utilizing the teaching of the present invention. The transformer 10 includes an enclosure or tank 11 with a lightning arrestor 12 and a primary high voltage bushing 16 mounted thereon. Secondary bushings 15 are attached to the enclosure 11 to which the transformer load is connected. A signal light 17 is mounted on the enclosure 11 with the circuit breaker 20 to be actuated at a predetermined low overload. A core and coil assembly 18 is secured inside the enclosure 11 with the circuit breaker 20 attached thereto. Required primary winding leads 14 extend from the core and coil assembly 18 to the appropriate high voltage bushings 16.

The housing 11 is partially filled with an insulating liquid dielectric 19, such as transformer oil. The circuit breaker 20 and the core and coil assembly 18 are immersed in the insulating oil 19. Secondary connections 22, coming from the core and coil assembly 18, connect to input terminals on circuit breaker 20. Conductors 24 connect the output terminals of circuit breaker 20 to the low voltage bushings 15 mounted to the transformer tank 11. Appropriate loads can then be connected to the low voltage terminals 26 of the distribution transformer 10.

Referring now to FIGS. 2 through 12, there are shown embodiments of circuit breaker 20 utilizing the teaching of the present invention. The two pole circuit interruptor 20 (FIG. 2) is mounted on a metallic base 30. A cover 32 is provided partially surrounding the sensing and tripping elements of the circuit breaker 20 to provide protection during handling. Secondary leads 22 of the core and coil assembly 18 are attached to incoming circuit breaker terminals 34. Electrical conductors 24, disposed between the circuit breaker 20 and the low voltage transformer bushings 15, attached to circuit breaker 20 at terminals 36. Circuit breaker terminals 34 connect to stationary contacts 38. Circuit breaker terminals 36 connect to stationary contact 40 through electrical conductor 42 and bimetal 44. Stationary contacts 38 and 40 of each pole are disposed in a spaced apart relationship.

A bridging contact 46 is provided which, with the circuit breaker in the closed position, completes an electrical connection between stationary contacts 38 and 40. Thus, with the circuit breaker 20 closed an electric circuit is completed from a terminal 34 through stationary contact 38, through bridging contact 46, through stationary contact 40, through electrical conductor 42, through bimetal 44, to circuit breaker terminal 36. The bridging contact assembly 45 includes the movable bridging contact 46 attached to one portion thereof which, when the circuit interrupter is closed, completes an electrical connection between stationary contacts 38 and 40.

In the disclosed distribution transformer the bridging contact is located below the bimetal 44. This is a most desirable feature since if for any reason a transformer should develop an oil leak the bimetal will be first to be exposed above the oil in the gas space and will heat up rapidly, causing the breaker to trip while the contacts 46, 38, and 40 are still under the oil. This sequence of operation is desirable since it prevents contact arcing in the volatile gas space above the reduced oil level.

Each pole of the circuit breaker 20 has an elongated contact arm 48 which at one end is rigidly secured to a through shaft 50. Shaft 50, which can be a metallic member, connects together the elongated contact arms 48 of all poles of the circuit breaker 20 for simultaneous movement. The bridging assembly 45 is connected to the end of the elongated contact arm 48 opposite shaft 50. An insulating member 52 is provided at the end of contact arm 48 so that contact arm 48 is electrically insulated from the contact bridging assembly 45. A spring 54 is provided in contact assembly 45 to provide uniform contact pressure and proper setting of the bridging contact 46 on the stationary contacts 38 and 40. As can be seen from the drawings, when any one of the poles of the circuit breaker 20 open all the other poles must also open.

Through shaft 50 is rotatably supported by brackets 55 which are attached to the metallic base 30. Stationary contacts 38 and 40 are electrically insulated from base plate 30 by insulating sheet 56 which is secured to base plate 30. Terminal 36 is connected to insulating sheet 58 which is rigidly secured to base plate 30. Electrical conductor 42 is insulated from base plate 30 by insulating sheets 56 and 58 and transformer oil 19 which fills the open spaces in the circuit breaker 20 during normal operation. Conductor 42 which is generally L-shaped (FIG. 4) has its short leg portion attached to one leg of bimetal 44. The other leg of bimetal 44 attaches to L-shaped terminal 36.

Figure 3:
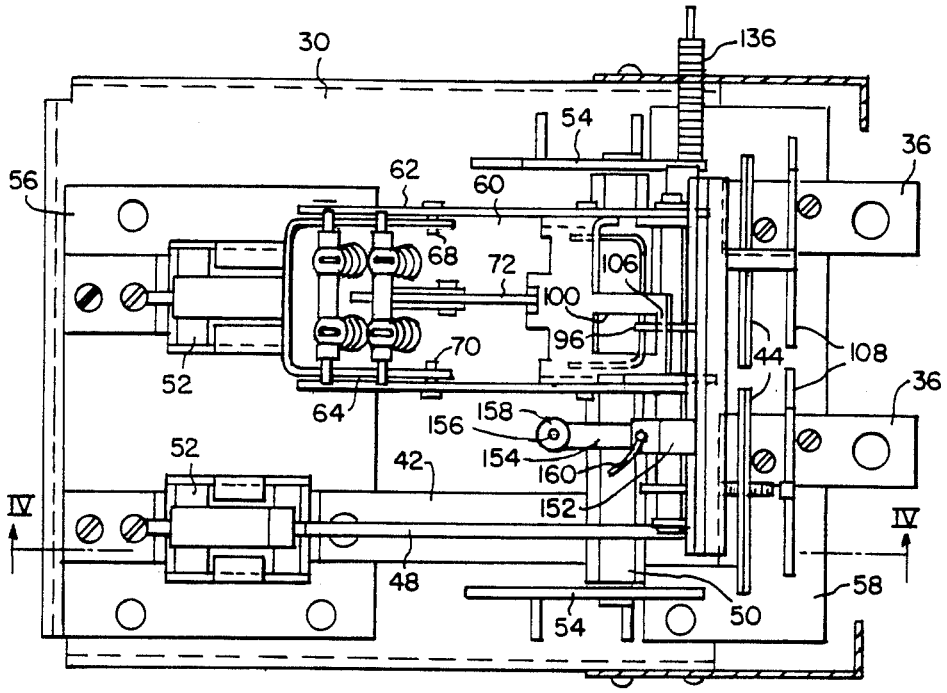
FIG. 3 is a top view of the circuit interrupter shown in FIG. 2 with the contacts in the closed position.
Figure 4:
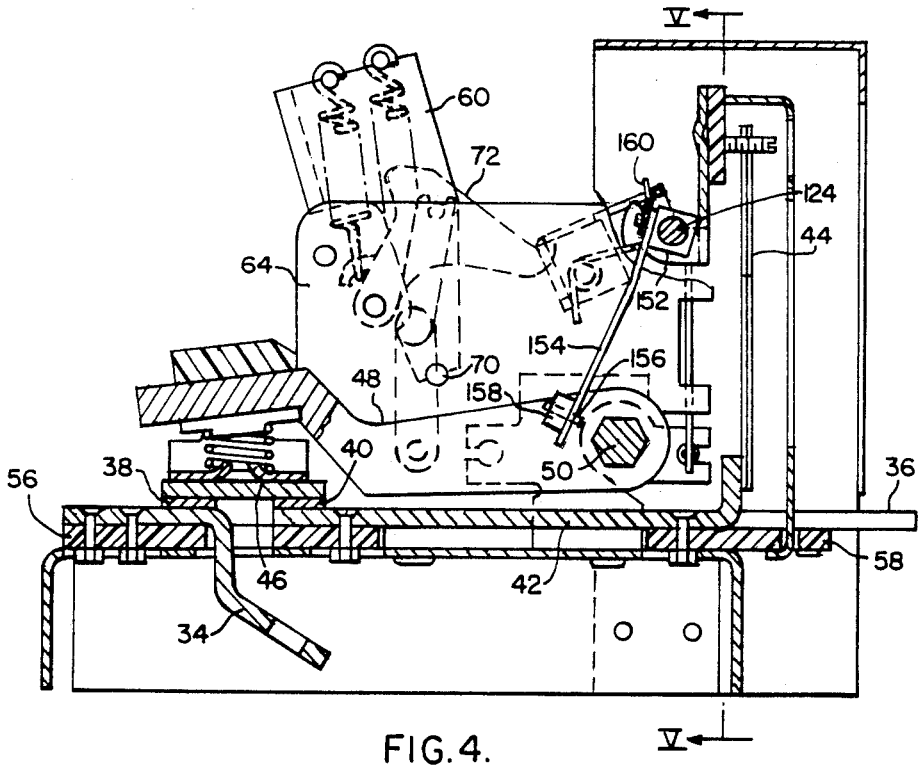
FIG. 4 is a side view of the circuit interrupter shown in FIG. 3 along the lines IV—IV.

A single operating mechanism or operator 60 is provided for operating all poles of the circuit breaker 20. Whether the circuit breaker 20 is a two pole type as disclosed herein or a three pole variety, only one operating assembly is required, as explained in U.S. Pat. No. 3,983,454. Operator 60 is connected to one of the elongated contact arms 48 and as this contact arm 48 is moved, in response to the positioning of the operator 60, the other elongated contact arm 48, connected to shaft 50, also responds. The single operating mechanism 60 for all poles is mounted on side plates 62 and 64 which are securely attached to support base 30. The operating mechanism comprises a U-shaped operating member 66, the two legs of which are pivotally connected to side plates 62 and 64 at points 68 and 70 respectively (FIG. 3).

A releasable arm of primary latch 72 (FIGS. 3, 4) is pivotally connected to a shaft 74 disposed between said plates 62 and 64. A pair of toggle links 76 and 78 (FIG. 7) are provided with one end of the toggle connected to the elongated contact arm 48 and the other end of the toggle connected to primary latch 72 and having multiple springs 80 connected between the knee of the toggle 82 and the top of U-shaped member 66 for raising contact arms 48 with a snap action when primary latch 72 is released. Toggle links 76 and 78 are pivotally connected together by knee pivot pin 82. The lower toggle member 76 is connected at its lower end by pivot pin 84 to an elongated contact arm 48. The upper ends of the pair of toggle links 78 have a U-shaped slot formed therein which fits around a shaft 86 connected to primary links 72. That is, primary latch 72 is disposed between the pair of toggles 78 so that shaft 86 fits into the U-shaped slot formed in the upper toggle links 78.

Spring holders 88 are attached to knee pin 82 and engage the lower ends of the plurality of springs 80. Shafts 90 fit on top of U-shaped member 66 and are engaged by the upper end of springs 80. The upward force exerted by springs 80 holds toggle links 78 in engagement with shaft 86 on primary latch 72. When the circuit breaker is assembled, the ends of the pair of links 78 are crimped to assure they remain in engagment with pin 86. Releasably primary latch 72 is held in a latched position by latch plate of secondary latch 92. Secondary latch 92 is biased toward an unlatched position by torsion spring 94. When the latch 92 moves to the unlatched position primary latch 72 is released and rotates around shaft 74 due to the force of springs 80 collapsing the toggle 76-78 and raising the elongated contact arms 48.

Secondary latch 92 is prevented from moving to the unlatched position when the breaker is closed by a cam surface 96 of a reciprocable cam 97 which is part of a trip bar mechanism 98. When the circuit breaker is normally closed (FIG. 7), a portion 106 of secondary latch 92 rests against the cam surface 96. When the trip bar mechanism is rotated a predetermined angle counterclockwise, the cam surface 96 passes through opening 100 in secondary latch 92 (FIG. 8) permitting secondary latch 92 to rotate to the unlatched position releasing primary latch 72 and tripping open the circuit breaker 20. Trip bar mechanism 98 is connected to be rotated by current responsive means when the current through the circuit breaker 20 exceeds a predetermined value.

Each pole of the circuit breaker 20 has an individual trip device including a current responsive bimetal elements 44, through which the load current of associated pole passes. That is, the bimetal element 44 is electrically connected in the circuit of the circuit breaker 20 in series relation with the breaker contacts 38, 40 and 46. The bimetal 44 is generally U-shaped with an adjusting screw 102 threadedly mounted in the bight portion. One leg of the bimetal 44 is connected to fixed conductor 42 and the other leg of bimetal 44 is connected to fixed terminal 36. Adjusting screw 102 is disposed so as to contact an insulating portion 104 of trip bar mechanism 98 when bimetal 44 deflects. Upon occurrence of, for example, an overload of less than 500% of normal rate current, the bimetal element is heated and deflects toward the trip bar mechanism 98. As the bimetal element deflects due to the flow of current therethrough, the adjusted screw 102 engages the insulating sheet 104 attached to trip bar mechanism 98, rotating the trip bar 98 counterclockwise to a tripped position releasing secondary latch 92 and tripping open the circuit breaker 20. The cam 96 of trip bar mechanism 98 moves from under the latching surface 106 to release the secondary latch 92. Primary latch 72 then rotates around pivot 74 moving the line of action of the springs 80 to the left of toggle pivot knee 82, causing the toggle 76-78 to collapse and open the circuit interrupter 20.

Figure 6:
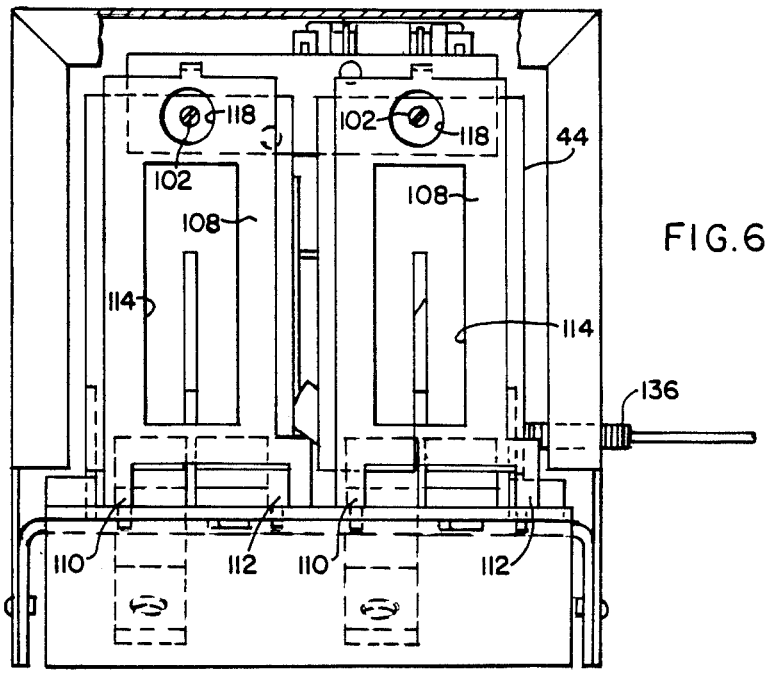
FIG. 6 is a rear view of the circuit interrupter shown in FIG. 2.
Figure 7:
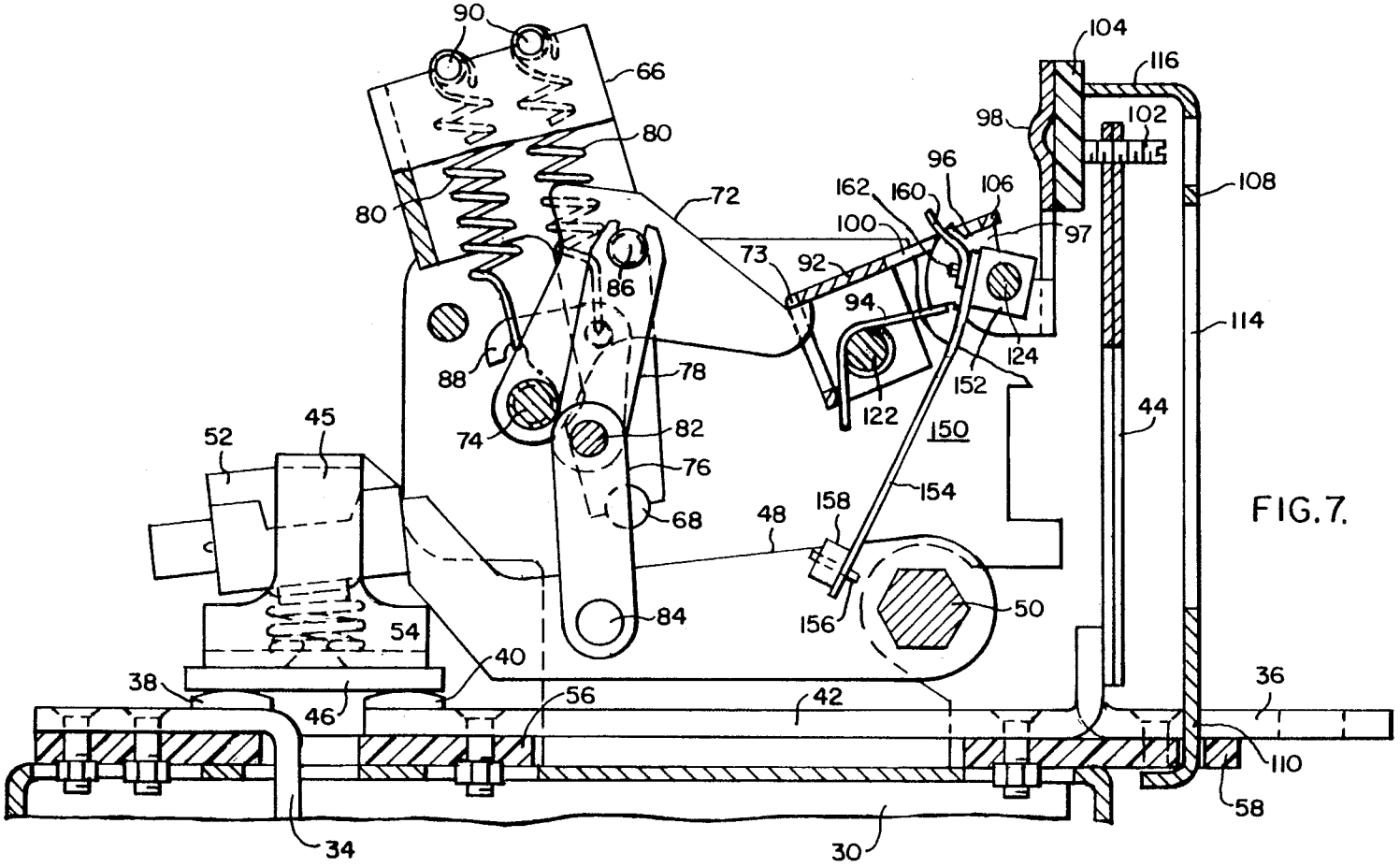
FIG. 7 is a side view of the circuit interrupter shown in FIG. 2, having portions removed for clarity, with the circuit breaker in the closed position.
Figure 8:
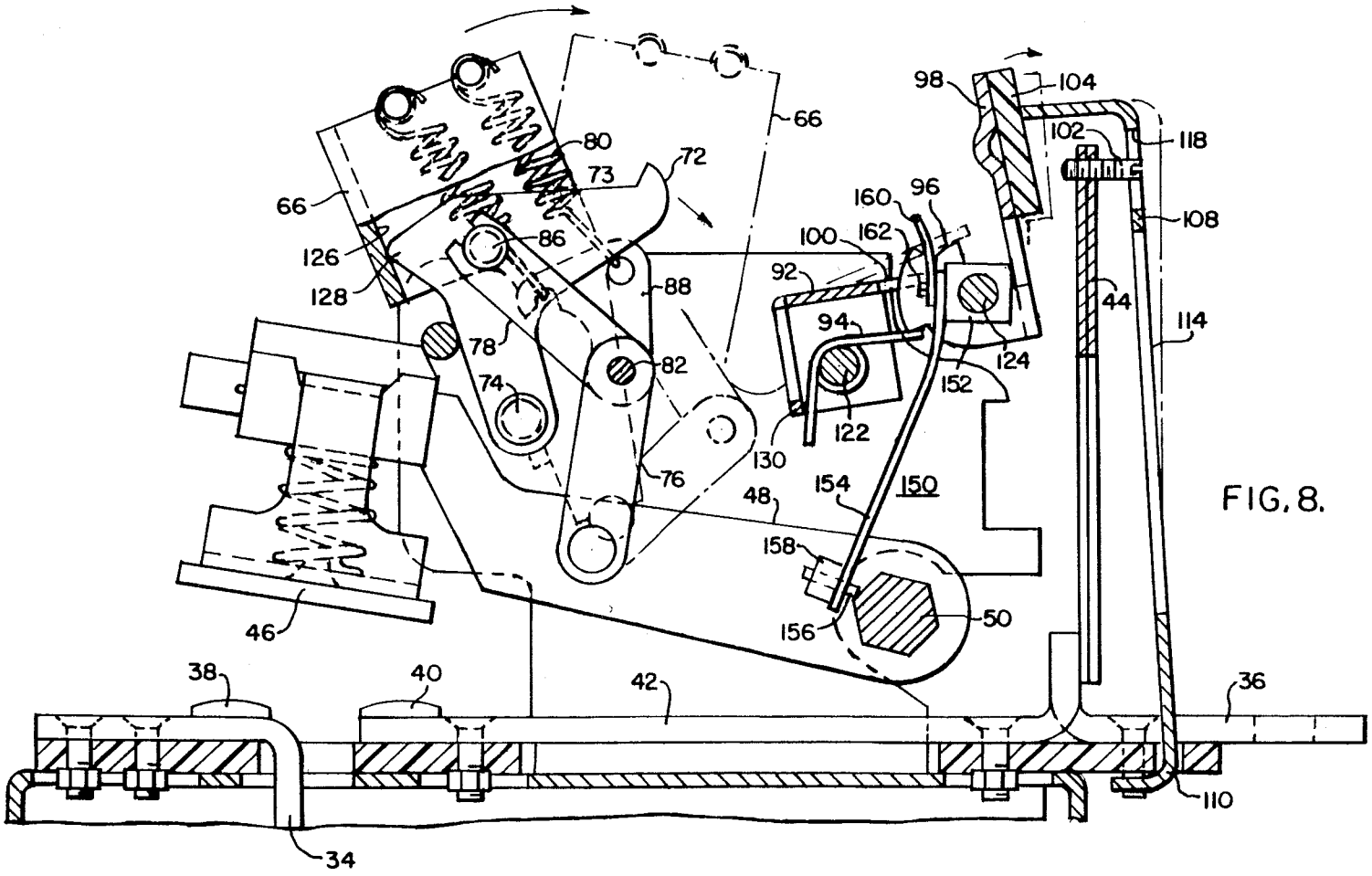
FIG. 8 is a side view of the circuit breaker shown in FIG. 2 having portions removed for clarity in the tripped open position.

The individual device also includes electromagnetic means to instantly trip the breaker. The electromagnetic trip means comprises a ferromagnetic member 108, disposed in proximity to bimetal element 44. Ferromagnetic member 108 (FIGS. 6, 7), formed from a single piece of sheet steel, is supported by two leg portions 110 and 112 which are secured in a pivotal manner to insulating member 58 (FIG. 6). A main opening 114 is formed through member 108 to achieve proper attraction during the required operation. A short arm 116 (FIG. 7) extends from electromagnetic trip member 108 towards the trip bar mechanism 98. Upon occurrence of a high overload current, of say for example, greater than 500% of normal rated current flowing through the bimetal 44, the electromagnetic trip member 108 is drawn towards bimetal 44 in response to the overload current, whereupon arm 116 engages insulating sheet 104 of trip bar mechanism 98 which rotates to trip open the circuit interrupter 20. Electromagnetic trip member 108 almost instantaneously trips open the circuit breaker 20 in the high overload conditions without moving bimetal 44.

As electromagnetic element 108 (FIG. 8) is drawn towards bimetal 44 trip arm 116 rotates trip bar 98 to release secondary latch 92, causing the circuit breaker 20 to trip open, and current flow through the bimetal ceases, and electromagnetic member 108 returns to its normal position. An opening 118 is also formed in electromagnetic trip member 108 to provide access to and clearance for adjusting screw 102 which is disposed in the bimetal 44.

Figure 9:
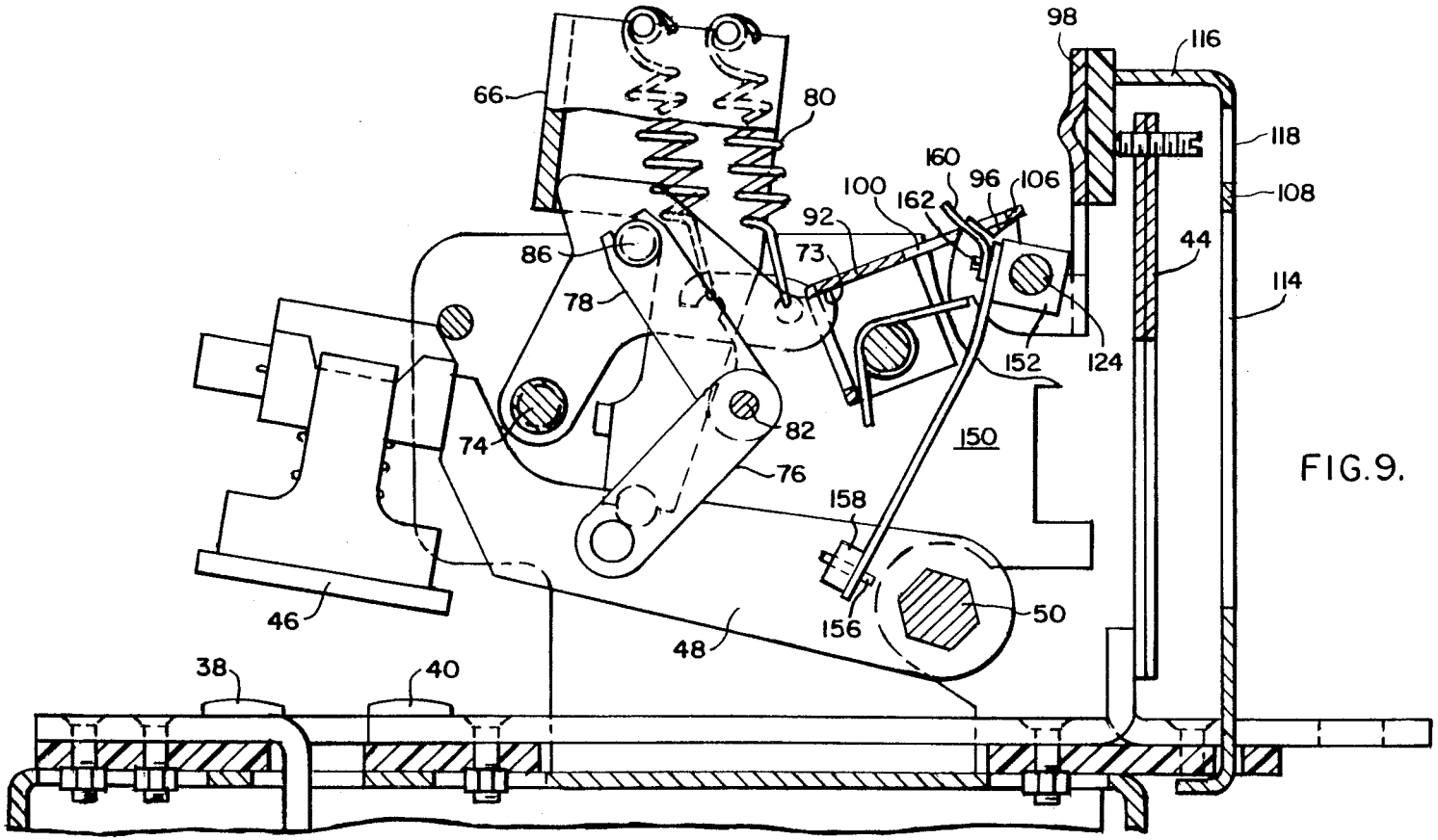
FIG. 9 is a side view of a portion of the circuit interruper shown in FIG. 2 in the normal open position.

Operating member 66 (FIG. 8) which rotates about pivots 68 and 70 provides a connection for one end of springs 80 and is mechanically linked to an operating handle 120 (FIG. 1) disposed on the transformer tank 11. Operating handle 120 is movable between on-off positions for closing and opening the circuit breaker 20. The circuit breaker contacts 38, 40, and 46 are manually opened by clockwise movement of operating member 66 (FIG. 7), as operating handle 120 is moved to the off position. Clockwise movement of the operator 66 carries the line of action of the overcenter springs 80 to the right of the longitudinal axis of link 78, whereupon the springs 80 cause a collapse of toggle 76-78, thereby moving the bridging contact 46 to the open position with a snap action. Contacts are closed by counterclockwise movement of the operator 66 (FIG. 9). This moves the line of action of the springs 80 across to the left of the longitudinal axis of link 78 about pivot pin 86. Consequently the springs 80 actuate the toggle 76-78 to its extended overcenter position, thereby moving the movable bridging contact 46 to the closed position with a snap action.

The circuit breaker 20 is held in the closed position by primary latch 72 which is rotatable about pivot point 74. The latching surface 73 on primary latch 72 is engaged by a portion of secondary latch 92 to hold primary latch 72 in the latched position. When secondary latch 92 rotates in a clockwise direction about pivot 122, primary latch 72 is released. Springs 80 force link 78 into engagment with shaft 86 of primary latch 72 and provide a counterclockwise bias on primary latch 72. That is, when primary latch 72 is released by secondary latch 92, springs 80, acting through link 78, rotate primary latch 72. When primary latch 72 is rotated a distance sufficient so that the longitudinal axis of link 78, which is also the connecting axis between the center pin 82 and shaft 86, passes to the left of the line of action of springs 80 formed between pin 82 and top support pins 90, the toggle 76-78 collapses with a snap action moving to the position shown in FIG. 8. That is, when primary latch 72 is released, it rotates permitting toggle 76-78 to collapse, opening circuit interruptor 20. Latch 72 is released when the current flow through the breaker exceeds a select overload value.

Secondary latch 92 holds primary latch 72 in a latched position. When secondary latch 92 rotates clockwise around shaft 122 to the position shown in FIG. 8, primary latch 72 is released, tripping open the circuit breaker 20. Secondary latch 92 is held in a latched position by cam 97 of trip bar 98. Trip bar 98 is mounted for rotation on shaft 124. When trip bar 98 is rotated counterclockwise around shaft 124 secondary latch 92 is released permitting the circuit breaker 20 to trip open.

When the circuit breaker 20 has tripped open, the primary latch 72 and the secondary latch 92 must be reset to a latched position before the circuit breaker can be closed. Relatching of the operating mechanism is effectuated by movement of the operator handle beyond the off position. Moving the operator handle to the off position moves operating part 66 in a clockwise direction. During this movement a portion 126 of operator 66 engages a projection 128 (FIG. 8) of primary latch 72 moving primary latch 72 in a clockwise direction about pivot 74. As operating part 66 is moved beyond the normal off position latch 72 engages a portion 130 of secondary latch 92, rotating secondary latch 92 in a counterclockwise direction, releasing trip bar 98, and causing the bar to rotate about shaft 124 under the influence of biasing spring 94. Trip bar 98 rotates to a position securing latch 92 where cam surface 96 acts as a support for secondary latch 92, holding secondary latch 92 latched. As the operator 66 moves from a reset position beyond the normal off position back to the normal off position surface 73 of primary latch 72 engages secondary latch 92 latching secondary latch 72 in the normal reset position. Thus, primary latch 72 and secondary latch 92 are both in the latched position (FIG. 9). The circuit breaker 20 may then be closed by movement of the operating handle 120 to the on position, causing the circuit breaker 20 to close in the previously described manner.

It is at times essential that operation of a transformer 10 be restored, at least temporarily, immediately after the circuit has been opened by operation of the transformer breaker 20 in response to an overload condition. However, there are occasions where it is difficult or impossible to reclose the breaker 20, especially if the oil 19 has been heated by a long continued overload current or a high ambient temperature, since the hot oil maintains the bimetal element 44 deflected to its trip position and the operating assembly 60 cannot be reset. An emergency control is provided for emergency adjustment of the tripping mechanism to permit the circuit breaker to be closed and latched immediately following a tripping operation.

Figure 5:
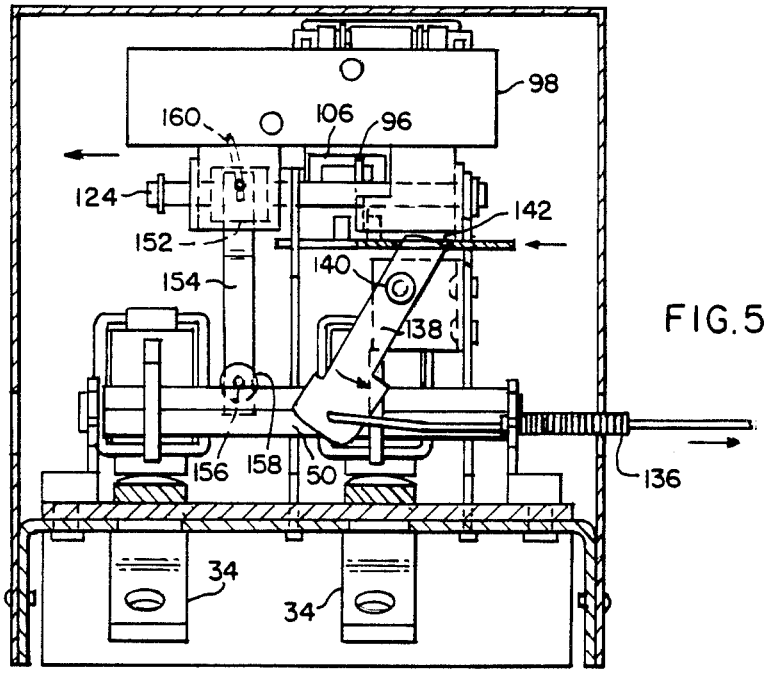
FIG. 5 is a view of the circuit interrupter shown in FIG. 4 along the lines V—V.
Figure 13:
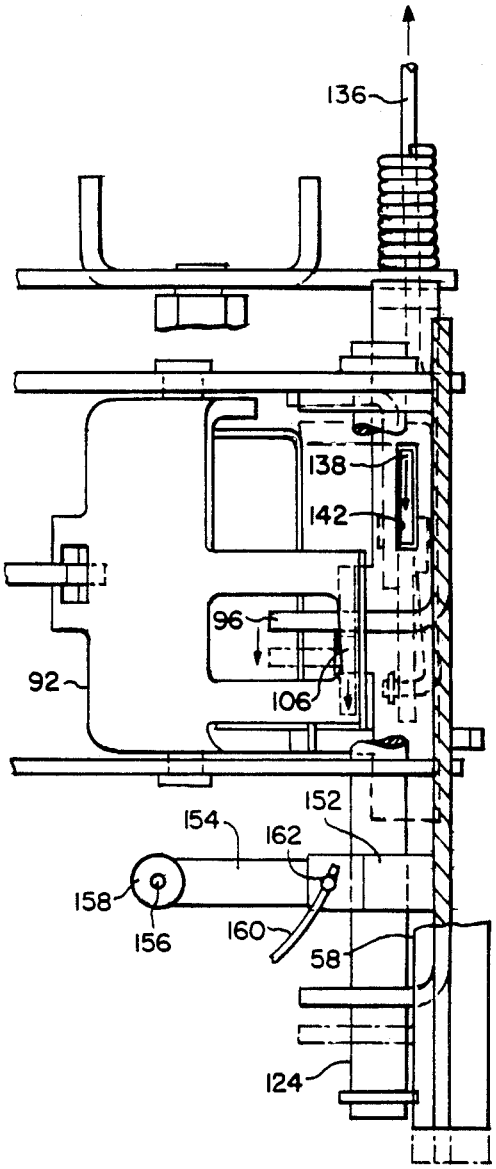
FIG. 13 is a top view of a portion of the circuit interrupter shown in FIG. 2, showing the emergency control settings.
Figure 11:
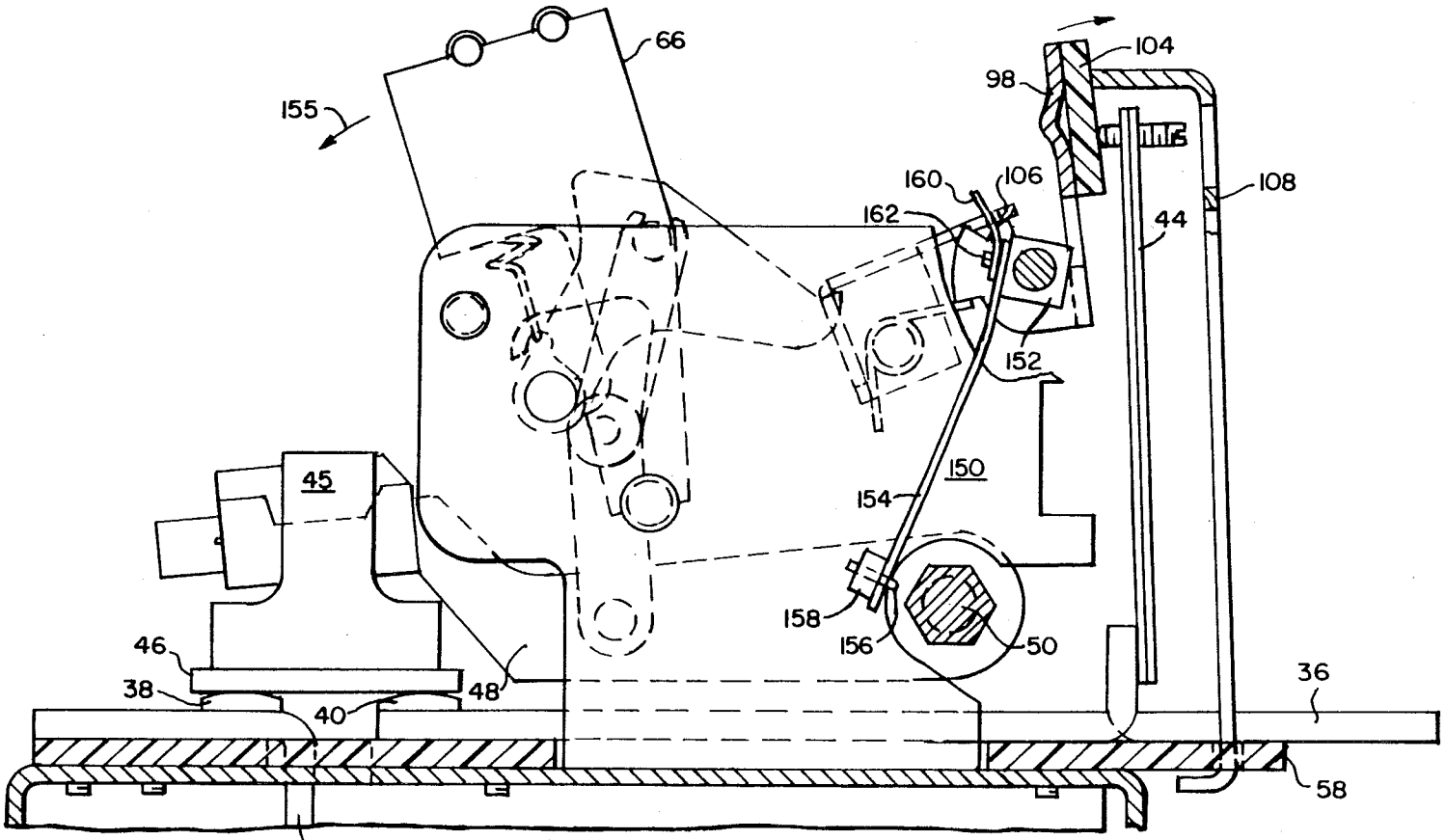
FIG. 11 is a side view of a portion of circuit interrupter shown in FIG. 2 with the signal contact in the closed position.

The emergency control permits the breaker 20 to temporarily carry a certain percentage of overload current for a predetermined time. The emergency control essentially permits changing of the circuit breaker 20 trip level. The emergency control can best be understood with reference to FIGS. 2, 3, 5, and 13. Trip bar mechanism 98 is slidably attached to shaft 124. The latching surface 106 of secondary latch 92, which is held by cam 96, is of a non-uniform width. That is, the latching surface, as viewed in FIGS. 3 and 13, is narrowest at the right hand or bottom end thereof and becomes progressively wider towards the left or top end thereof. During normal operation of the circuit interrupter, as shown by phantom lines in FIG. 13, the cam 96 supports a narrow portion of the latching surface 106. During an emergency operation the trip bar mechanism 98 is slided along shaft 124 to a position as shown in FIGS. 3, 5, and 13, wherein the cam surface 96 supports a wider portion of latching surface 106, thus requiring further rotation of cam 96 to release secondary latch 92. This increased rotation of the trip bar mechanism 98 around shaft 124 required to release secondary latch 92 effectively increases the circuit breaker 20 rating.

As can best be seen in FIG. 5, push-pull cable 136 connects to a lever 138, pivoted about point 140 and having a free end which engages a slot 142 formed in a portion of the trip bar assembly 98. As push-pull cable 136 is operated the trip bar assembly 98 along the longitudinal axis of shaft 124, effectively changing the circuit breaker 20 rating. During normal operation a narrow portion of latch surface 106 rests on cam 96 and during emergency overload operation a wide portion of latch surface 106 rests on cam surface 96. Push-pull cable 136 is connected at one end to lever 138 and at the other end to operating handle 146 which is mounted externally on the transformer tank 11. Thus, the rating of the circuit breaker 20 can be increased by moving the external emergency control handle 146 from the normal position to the emergency overload position.

Signal means is also provided for indicating an overload condition that is not of sufficient magnitude to trip the breaker 20 open, but which indicates that the current in the circuit is approaching a dangerous overload condition or that a dangerous overload condition has existed and has cleared itself without tripping the breaker 20. The signal indicating means also indicates that the breaker 26 has been tripped open in response to an overload current.

The signal means comprises a signal switch 150 (FIGS. 7–13) including an insulating mounting block 152, a flexible switch arm 154, a contact 156, and magnet means or permanent magnet 158. The mounting block 152 is composed of electrically insulating material and is fixedly mounted on the shaft 124, whereby it rotates with the cam 97 and the trip bar mechanism 98 which are also mounted on the shaft. The switch arm 154 is fixedly mounted on one side of the block 152 and is preferably comprised of a non-magnetic, flexible strip of metal. It includes a lower end portion which is spaced from the shaft 50 by a calibrated distance. The magnet 158 provides a finite magnetically produced holding force between the switch arm 150 and the shaft 50. The circuit breaker 20 is mounted within the transformer tank, so that when the contact 156 contacts the shaft 50, a circuit is closed through the shaft, the signal switch 150 and a conductor wire 160 extending to the signal light 17. The wire 160 is secured to the upper end of the arm 154 in a suitable manner such as by a screw 162 by which the arm is mounted on the block 152.

Figure 12:
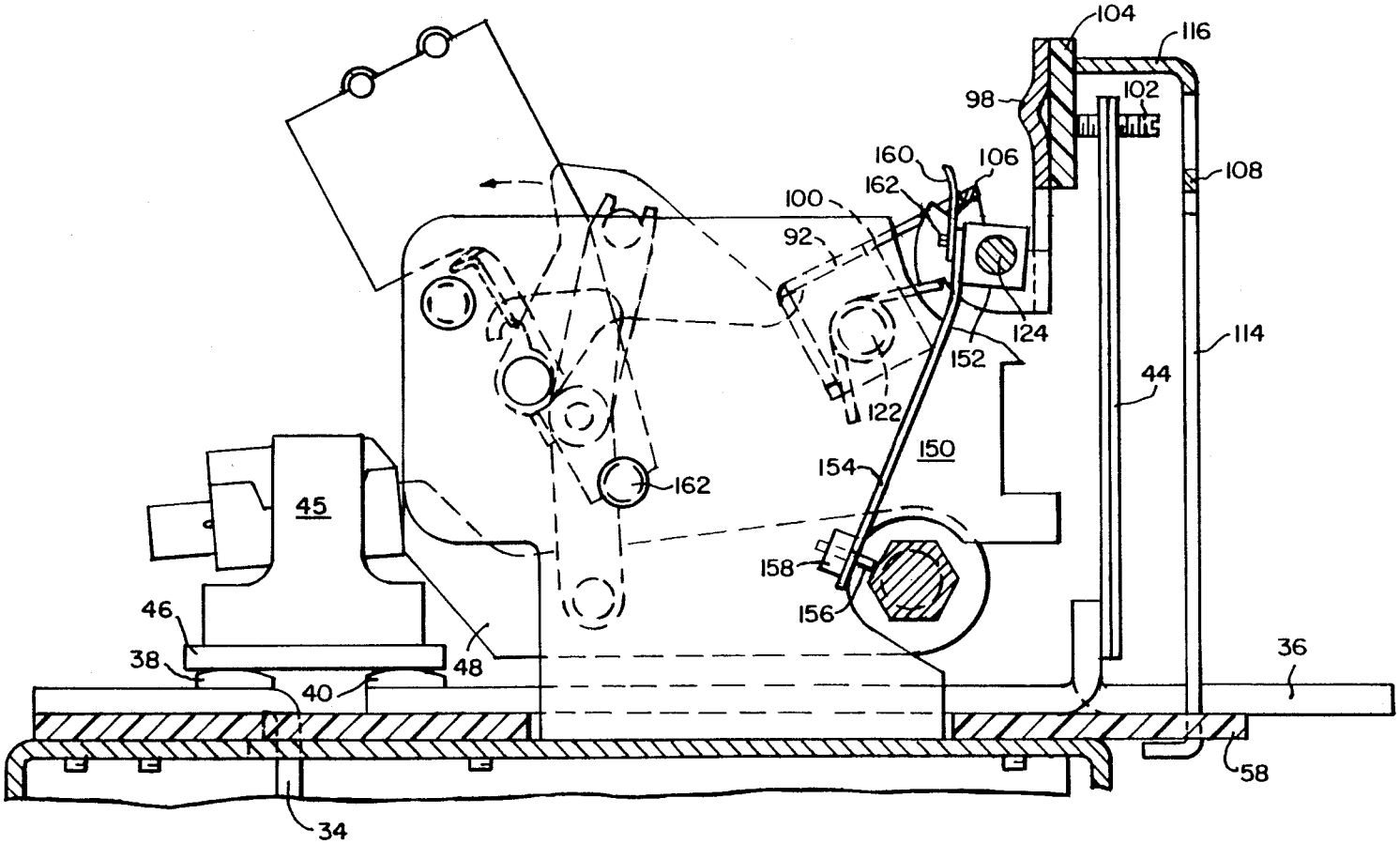
FIG. 12 is a side view of circuit interrupter shown in FIG. 2 with the operating handle moved past normal position to reset the signal light contact.

As the trip bar mechanism 98 is rotated counterclockwise due to an overload current, the cam 97 is rotated, causing the switch arm 154 and contact 156 to move into electrical contact with the shaft 50 (FIG. 12). If the overload current condition is sufficient to rotate the cam 97 sufficiently far, the latch plate 92 moves to an unlatched position (FIG. 8) whereby the circuit breaker is tripped to the open position with the signal switch 150 in a closed contact condition.

Where, however, the current overload is not sufficient to cause the bimetal 44 to deflect the cam far enough so that the cam surface 96 continues to support the trip plate 92 at location 164 (FIG. 12), the circuit breaker 20 remains in the closed circuit condition with the signal light 17 on.

Subsequently, if the overload current subsides, the bimetal 44 cools so that some of its previous deflection returns to the initial position of the ambient temperature. However, the trip bar 98 does not deflect back because the frictional force at location 164 exceeds the force of the springs 80, whereby the trip bar is effectively latched at the most forward position while being pushed by the bimetal. If the most forward position coincides with the position at which the signal light 17 should turn on, the trip bar 98 is latched at the signal trip position. The adaptation of this latchable rotational motion of the trip bar to turn on the signal light requires only a simple single-pole switch to close at the forward position that coincides with the signal trip position.

This latching on can only be released by removing the frictional force at location 164 after the bimetal 44 has moved back beyond the signal trip position. The frictional force is removed when the breaker is open either by tripping or by manual movement of the operating handle 120.

As the bimetal 44 is heated, the switch arm 154 moves towards the fixed contact or shaft 50. At some point, the magnetic force of attraction of the magnet 158 becomes great enough to move the contact 156 into contact with the shaft 50 in a snap action manner. If the bimetal is permitted to cool immediately following the initial contact, there will not be over-travel of the trip bar system. As the bimetal cools, it moves back. During the first small increment of its backward motion, the force of the trip bar 98 is reduced and the trip bar system is allowed to relax. Because of this relaxation, the moving contact 156 would tend to move away from the fixed contact or shaft 50. However, the moving contact 156 is held by the magnet 158 and the electrical circuit is maintained through this relaxation.

Figure 10:
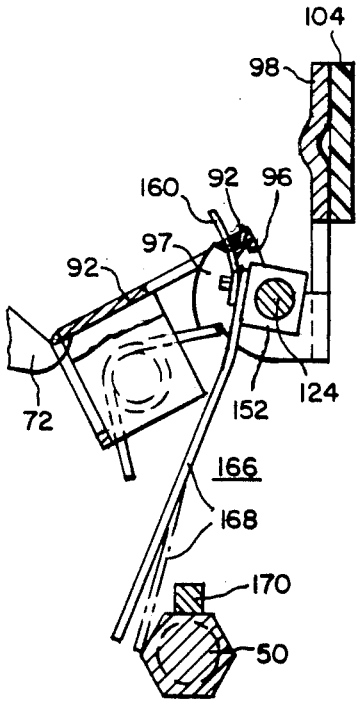
FIG. 10 is a schematic view of another embodiment of the present invention.

Another embodiment of the invention is shown in FIG. 10 in which a signal switch 166 is provided. Similar numerals refer to similar parts of switch 150 whereby the switch 166 includes the block 152, the conductor wire 160, a magnetic flexible arm 168, and a permanent magnet 170 mounted on the shaft 50. The operation of the switch 166 is functionally the same as that for the switch 150. Accordingly, as the trip bar 98 is rotated, the flexible arm 168 which is magnetic (as opposed to the non-magnetic arm 154) moves into the magnetic field of the permanent magnet 170 whereby it closes the circuit as shown by the broken line position 168.

In conclusion, the device of the present invention maintains a signal light in the on position even though an overload current condition subsides before tripping the main transformer contacts, and thereby indicates that there has been a current overload condition less than the critical overload, but nevertheless may require replacement of a higher rated transformer. The importance of the magnet is that it holds the mechanism in place, is less sensitive to temperature variations, and maintains a circuit through the signal light. The magnet provides hysteresis to compensate for relaxation of the mechanism.

What is claimed is:

1. A distribution transformer comprising:

a housing;

a transformer within the housing;

a circuit interrupter disposed within the housing and operable between a closed position permitting current flow through the transformer and an open position interrupting flow through the transformer, the circuit interrupter being operable to automatically trip to the open position upon overload current conditions through the transformer;

the circuit breaker including a releasable latch arm operable to maintain the circuit breaker in closed position;

a latch plate movable between latched and unlatched positions of said arm;

a reciprocable cam movable between unlatched and latched positions of the plate and having a cam surface engageable with the plate, reciprocable trip means operable upon overload current conditions to rotate the cam to the unlatched position;

signal means for indicating when overload current conditions exceed a predetermined level and including a switch arm and a moving contact on the arm, the arm being movable with the cam for moving the contact to open and close a signal circuit;

the cam and the switch arm being mounted on a rotatable shaft and the contact being mounted on a portion of the switch arm from the shaft and the cam surface being a circular arc of a predetermined constant radius;

the contact being movable to open and close the signal circuit;

the contact closing the signal circuit during rotation of the cam toward the unlatched condition; and magnetic means being associated with the contact for maintaining the contact in a closed condition so long as the circuit interrupter is in closed position.

2. The distribution transformer of claim 1 in which the magnetic means comprises a magnet on the switch arm adjacent to the contact.

3. The distribution transformer of claim 1 in which the magnetic means comprises a magnet mounted adjacent to the closed position of the contact.

4. The distribution transformer of claim 1 in which the circuit interrupter includes frame structure, the contact being movable with respect to the frame to open and close the signal circuit.

5. The distribution transformer of claim 4 in which the magnetic means includes a permanent magnet adjacent to the contact for attracting the contact to the closed circuit condition.

6. the distribution transformer of claim 5 in which the magnet is mounted on the switch arm adjacent to the contact.

7. The distribution transformer of claim 5, in which the magnet is on the frame structure.

8. The distribution transformer of claim 6 in which the switch arm is a non-magnetic flexible arm.

9. The distribution transformer of claim 7 in which the switch arm is a magnetic flexible arm.

* * * * *